US007749356B2

(12) United States Patent
Runge et al.

(10) Patent No.: US 7,749,356 B2
(45) **Date of Patent: *Jul. 6, 2010**

(54) METHOD FOR USING WATER INSOLUBLE CHEMICAL ADDITIVES WITH PULP AND PRODUCTS MADE BY SAID METHOD

(75) Inventors: Troy Michael Runge, Neenah, WI (US); Louise Cynthia Ellis Coe, Appleton, WI (US); Mike Thomas Goulet, Neenah, WI (US); Ricardo Toru Nishihata, Jacarei (BR); Vera Maria Sacon, São Paulo (BR)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1708 days.

This patent is subject to a terminal disclaimer.

(21) Appl. No.: 09/800,645

(22) Filed: Mar. 7, 2001

(65) Prior Publication Data

US 2002/0162243 A1 Nov. 7, 2002

(51) Int. Cl.
*D21F 11/00* (2006.01)

(52) U.S. Cl. ..... 162/158; 162/109; 162/111; 162/112; 162/113; 162/164.3; 162/164.8; 162/168.1; 162/179

(58) Field of Classification Search ..... 162/109, 162/111–113, 158, 164.3, 164.4, 168.1–168.3, 162/170–175, 179, 180, 181.1, 181.2, 181.6
See application file for complete search history.

(56) References Cited

U.S. PATENT DOCUMENTS

| | | | | |
|---|---|---|---|---|
| 1,812,832 | A | | 6/1931 | Rafton |
| 2,061,935 | A | | 11/1936 | Delcroix |
| 2,110,032 | A | | 3/1938 | Williams |
| 2,606,115 | A | | 8/1952 | Nuessle et al. |
| 2,799,241 | A | | 7/1957 | Wurster |
| 3,014,832 | A | | 12/1961 | Donnelly |
| 3,056,714 | A | | 10/1962 | Feigley, Jr. et al. |
| 3,089,824 | A | | 5/1963 | Wurster |
| 3,117,027 | A | | 1/1964 | Lindlof et al. |
| 3,196,827 | A | | 7/1965 | Wurster et al. |
| 3,207,824 | A | | 9/1965 | Wurster et al. |
| 3,241,520 | A | | 3/1966 | Wurster et al. |
| 3,253,944 | A | | 5/1966 | Wurster |
| 3,395,708 | A | | 8/1968 | Hervey et al. |
| 3,554,862 | A | | 1/1971 | Hervey et al. |
| 3,554,863 | A | | 1/1971 | Hervey et al. |
| 3,556,931 | A | * | 1/1971 | Champaigne ..... 162/158 |
| 3,677,886 | A | | 7/1972 | Forssblad et al. |
| 3,756,913 | A | | 9/1973 | Wodka |
| 3,770,575 | A | | 11/1973 | Ball |
| 3,819,470 | A | * | 6/1974 | Shaw et al. ..... 162/157.6 |
| 3,821,073 | A | | 6/1974 | Eriksson |
| 3,994,771 | A | | 11/1976 | Morgan, Jr. et al. |
| 4,014,736 | A | | 3/1977 | Sexton |
| 4,046,621 | A | | 9/1977 | Sexton |
| 4,049,493 | A | | 9/1977 | Lare |
| 4,081,319 | A | | 3/1978 | Conway |
| 4,093,506 | A | | 6/1978 | Richter |
| 4,128,692 | A | | 12/1978 | Reid |
| 4,144,122 | A | | 3/1979 | Emanuelsson et al. |
| 4,198,267 | A | | 4/1980 | Flaherty |
| 4,302,488 | A | | 11/1981 | Lowi, Jr. |
| 4,310,384 | A | | 1/1982 | Meredith et al. |
| 4,326,000 | A | | 4/1982 | Roberts, Jr. |
| 4,383,834 | A | | 5/1983 | Degen et al. |
| 4,431,481 | A | | 2/1984 | Drach et al. |
| 4,432,833 | A | | 2/1984 | Breese |
| 4,448,638 | A | | 5/1984 | Klowak |
| 4,481,076 | A | | 11/1984 | Herrick |
| 4,481,077 | A | | 11/1984 | Herrick |

(Continued)

FOREIGN PATENT DOCUMENTS

EP 0 109 282 A2 5/1984

(Continued)

OTHER PUBLICATIONS

Saint-Cyr, Karine, Adsorption Kinetics of Dyes and Yellowing Inhibitors on Pulp Fibers, Master of Engineering Thesis, McGill University, Montreal, Canada, Jun. 1999.*

(Continued)

*Primary Examiner*—Mark Halpern
(74) *Attorney, Agent, or Firm*—Gregory E. Croft

(57) ABSTRACT

Pulp fibers can be treated with water insoluble chemical additives resulting in a minimal amount of unretained water insoluble chemical additives present after redispersing the treated pulp fibers in the process water. One embodiment of the present invention is a method for preparing chemically treated pulp fiber. A fiber slurry is created comprising process water and pulp fibers. The fiber slurry is transported to a web-forming apparatus of a pulp sheet machine thereby forming a wet fibrous web. The wet fibrous web is dried to a predetermined consistency thereby forming a dried fibrous web. The dried fibrous web is treated with a water insoluble chemical additive thereby forming a chemically treated dried fibrous web containing chemically treated pulp fibers. The chemically treated pulp fibers have an improved level of chemical retention of the water insoluble chemical additive and retain from between about 25 to about 100 percent of the applied amount of the water insoluble chemical additive when the chemically treated pulp fibers are redispersed in water.

33 Claims, 5 Drawing Sheets

U.S. PATENT DOCUMENTS 4,482,429 A 11/1984 Klowak
4,506,081 A 3/1985 Fenyes et al.
4,508,860 A 4/1985 Hawes
4,510,020 A 4/1985 Green et al.
4,623,588 A 11/1986 Nuwayser et al.
4,624,743 A 11/1986 Gess
4,675,140 A 6/1987 Sparks et al.
4,720,383 A 1/1988 Drach et al.
4,808,266 A 2/1989 Faurie
4,853,086 A 8/1989 Graef
4,908,101 A 3/1990 Frisk et al.
4,969,976 A 11/1990 Reed
4,986,882 A 1/1991 Mackey et al.
5,035,772 A 7/1991 Agnemo et al.
5,073,234 A 12/1991 Mollett et al.
5,087,324 A 2/1992 Awofeso et al.
5,096,539 A 3/1992 Allan
5,102,500 A 4/1992 Darlington
5,127,994 A 7/1992 Johansson
5,137,600 A 8/1992 Barnes et al.
5,139,671 A 8/1992 Henricson et al.
5,164,046 A 11/1992 Ampulski et al.
5,221,434 A 6/1993 Henricson
5,223,090 A 6/1993 Klungness et al.
5,238,501 A 8/1993 Kappel et al.
5,254,168 A 10/1993 Littman et al.
5,296,024 A 3/1994 Hutcheson
5,348,620 A 9/1994 Hermans et al.
5,389,204 A 2/1995 Ampulski
5,393,334 A 2/1995 Hutcheson
5,397,435 A 3/1995 Ostendorf et al.
5,399,241 A 3/1995 Oriaran et al.
5,405,499 A 4/1995 Vinson
5,405,501 A 4/1995 Phan et al.
5,437,766 A 8/1995 Van Phan et al.
5,443,899 A 8/1995 Barcus et al.
5,494,554 A 2/1996 Edwards et al.
5,501,768 A 3/1996 Hermans et al.
5,547,541 A * 8/1996 Hansen et al. ..... 162/12
5,552,020 A 9/1996 Smith et al.
5,591,306 A 1/1997 Kaun
5,603,804 A 2/1997 Hansen et al.
5,607,551 A 3/1997 Farrington, Jr. et al.
5,624,532 A 4/1997 Trokhan et al.
5,625,015 A 4/1997 Brinen et al.
5,649,915 A 7/1997 Chauvette et al.
5,656,132 A 8/1997 Farrington, Jr. et al.
5,667,636 A 9/1997 Engel et al.
5,672,248 A 9/1997 Wendt et al.
5,679,218 A 10/1997 Vinson et al.
5,695,607 A 12/1997 Oriaran et al.
5,725,736 A 3/1998 Schroeder et al.
5,730,839 A 3/1998 Wendt et al.
5,753,079 A 5/1998 Jenny et al.
5,759,349 A 6/1998 Foster et al.
5,772,845 A 6/1998 Farrington, Jr. et al.
5,785,813 A 7/1998 Smith et al.
5,788,815 A 8/1998 Norell et al.
5,830,320 A 11/1998 Park et al.
5,853,539 A 12/1998 Smith et al.
5,928,470 A 7/1999 Shannon
5,958,180 A 9/1999 Hubbe et al.
6,027,611 A 2/2000 McFarland et al.
6,054,020 A 4/2000 Goulet et al.
6,074,524 A 6/2000 Wu et al.
6,126,784 A 10/2000 Ficke et al.
6,136,147 A 10/2000 Edwards et al.
6,162,329 A 12/2000 Vinson et al.
6,171,441 B1 1/2001 Phillips et al.
6,245,874 B1 6/2001 Staib et al.
6,322,665 B1 11/2001 Sun et al.
6,332,952 B1 12/2001 Hsu et al.
6,344,109 B1 * 2/2002 Gross ..... 162/100
6,379,498 B1 4/2002 Burns et al.
6,383,337 B1 5/2002 Meinecke et al.
6,423,183 B1 7/2002 Goulet et al.
6,582,560 B2 * 6/2003 Runge et al. ..... 162/182
2002/0088582 A1 7/2002 Burns et al.
2002/0139500 A1 10/2002 Runge et al.
2003/0159786 A1 8/2003 Runge et al.

FOREIGN PATENT DOCUMENTS

EP 0 116 512 A1 8/1984
EP 0 132 128 A1 1/1985
EP 0 335 576 A2 10/1989
EP 0 226 408 B1 7/1991
EP 0 613 979 A1 9/1994
EP 0 772 716 B1 5/1997
EP 0 643 164 B1 11/1997
EP 0 851 062 A2 7/1998
GB 1 407 134 9/1975
JP 07-189170 A 7/1995
JP 07-189171 A 7/1995
WO WO 89/02952 A1 4/1989
WO WO 90/12146 A1 10/1990
WO WO 94/19534 A1 9/1994
WO WO 95/01479 A1 1/1995
WO WO 95/20066 A1 7/1995
WO WO 96/06223 A1 2/1996
WO WO 97/13026 A1 4/1997
WO WO 97/31153 A1 8/1997
WO WO 98/09021 A1 3/1998
WO WO 98/16570 A1 4/1998
WO WO 98/17856 A1 4/1998
WO WO 98/17864 A1 4/1998
WO WO 98/23814 A1 6/1998
WO WO 98/35095 A1 8/1998
WO WO 99/31312 A1 6/1999
WO WO99/34057 A1 7/1999
WO WO 00/66835 A1 11/2000

OTHER PUBLICATIONS

*Pulp and Paper Manufacture: The Pulping of Wood*, Second Edition, vol. 1, pp. 33-72, Ronald G. MacDonald, editor.

Haylock, E.W., Editor, Chapter 5, "Preparation of Pulp for the Paper Machine," Chapter 6, "The Fourdrinier Paper Machine," and Chapter 7, "Special Paper Machines. Board Manufacture," *Paper: Its Making, Merchanting and Usage*, The National Association of Paper Merchants, London, 1975, pp. 49-101.

Smook, Gary A., Editor, "Non-Fibrous Additives to Papermaking Stock," Chapter 15, *Handbook for Pulp & Paper Technologists*, Second Edition, Angus Wilde Publications, Bellingham, WA, 1992, pp. 220, 225-226.

* cited by examiner

METHOD FOR USING WATER INSOLUBLE CHEMICAL ADDITIVES WITH PULP AND PRODUCTS MADE BY SAID METHOD

BACKGROUND OF THE INVENTION

In the manufacture of paper products, it is often desirable to enhance physical and/or optical properties by the addition of chemical additives. Typically, chemical additives such as softeners, colorants, brighteners, strength agents, etc. are added to the fiber slurry upstream of the headbox in a paper making machine during manufacturing to impart certain attributes to the finished product. These chemical additives are usually mixed in a stock chest or stock line where the fiber slurry has a fiber consistency of from between about 0.15 to about 5 percent or spraying the wet or dry paper or tissue during production.

One disadvantage of adding a chemical additive at each paper machine is that the manufacturer has to install equipment on each paper machine to accomplish the chemical additive addition. This, in many cases, is a costly proposition. In addition, the uniformity of the finished product coming off of each paper machine may vary depending upon how the chemical additive was added, variations in chemical additive uniformity and concentrations, the exact point of chemical additive introduction, water chemistry differences among the paper machines as well as personnel and operational differences of each paper machine.

Another difficulty associated with wet end chemical additive addition is that the water soluble or water dispersible chemical additives are suspended in water and are not completely adsorbed or retained onto the fibers prior to formation of the wet mat. To improve adsorption of wet end chemical additives. the chemical additives are often modified with functional groups to impart an electrical charge when in water. The electrokinetic attraction between charged chemical additives and the anionically charged fiber surfaces aids in the deposition and retention of chemical additives onto the fibers. Nevertheless, the amount of the chemical additive that can be adsorbed or retained in the paper machine wet end generally follows an adsorption curve exhibiting diminishing incremental adsorption with increasing concentration, similar to that described by Langmuir. As a result, the adsorption of water soluble or water dispersible chemical additives may be significantly less than 100 percent, particularly when trying to achieve high chemical additive loading levels. The use of water insoluble chemical additives in the water systems of papermaking processes is even more problematic and typically provides even poorer loading levels. Water insoluble chemical additives or water nondispersible chemical additives cannot typically be used in such water systems unless in the form of an emulsion.

Consequently, at any chemical addition level, and particularly at high addition levels, a fraction of the chemical additive is retained on the fiber surface. The remaining fraction of the chemical additive remains dissolved or dispersed in the suspending water phase. These unadsorbed or unretained chemical additives can cause a number of problems in the papermaking process. The exact nature of the chemical additive will determine the specific problems that may arise, but a partial list of problems that may result from unadsorbed or unretained chemical additives includes: foam, deposits, contamination of other fiber streams, poor fiber retention on the machine, compromised chemical layer purity in multi-layer products, dissolved solids build-up in the water system, interactions with other process chemicals, felt or fabric plugging, excessive adhesion or release on dryer surfaces, physical property variability in the finished product.

Therefore, what is lacking and needed in the art is an improved method for using water insoluble chemical additives, providing more consistent water insoluble chemical additive additions to the pulp fiber and a reduction or elimination of unretained water insoluble chemical additives in the process water on a paper machine. The method minimizes the associated manufacturing and finished product quality problems that would otherwise occur with conventional wet end chemical addition at the paper machine.

SUMMARY OF THE INVENTION

It has now been discovered that water insoluble chemical additives can be applied to pulp fibers at high and/or consistent levels with reduced amounts of unretained water insoluble chemical additives present in the papermaking process water after the treated pulp fiber has been redispersed in water. This is accomplished by treating a fibrous web prior to the finishing operation at a pulp mill with a water insoluble chemical additive, completing the finishing operation, redispersing the finished pulp at the paper mill and using the finished pulp in the production of a paper product.

Hence in one aspect, the invention resides in a method for preparing chemically treated pulp fibers. The method comprises creating a fiber slurry comprising process water and virgin pulp fibers. The fiber slurry is transported to a web-forming apparatus of a pulp sheet machine and formed into a wet fibrous web. The wet fibrous web is dried to a predetermined consistency thereby forming a dried fibrous web. The dried fibrous web is treated with a water insoluble chemical additive thereby forming a chemically treated dried fibrous web containing chemically treated pulp fibers wherein the chemically treated pulp fibers have an increased or improved level of chemical retention of the water insoluble chemical additive and have a level of chemical retention of the water insoluble chemical additive is between about 25 to about 100 percent retention of the applied amount of the water insoluble chemical additive when the chemically treated pulp fibers are redispersed in water. The level of chemical retention of the water insoluble chemical additive may range from between about 60 to about 100 percent or between about 80 to about 100 percent retention of the water insoluble chemical additive. The improved level of chemical retention of the water insoluble chemical additive, measured as the change in the level of chemical retention of adding by typical wet-end addition, may range from a lower limit of about 5 percent, about 15 percent, about 25 percent, about 35 percent, about 45 percent, about 55 percent, about 65 percent, and about 75 percent to a higher limit of about 25 percent, about 35 percent, about 45 percent, about 55 percent, about 65 percent, about 75 percent, about 85 percent, about 95 percent, and about 100 percent retention of the water insoluble chemical additive. It is understood that the value for the lower limit is less than the value for the upper limit. The chemically treated pulp fiber may be then used in a separate process to produce paper products.

In another aspect, the invention resides in a method for applying a water insoluble chemical additive to pulp fiber. The method comprises mixing pulp fibers with process water to form a fiber slurry. The fiber slurry is transported to a web-forming apparatus of a pulp sheet machine and forming a wet fibrous web. The wet fibrous web is dewatered to a predetermined consistency thereby forming a dewatered fibrous web. A water insoluble chemical additive is applied to the dewatered fibrous web, thereby forming a chemically treated dewatered fibrous web containing chemically treated pulp fibers wherein the chemically treated pulp fibers have an increased or improved level of chemical retention of the water insoluble chemical additive wherein the level of chemical retention of the water insoluble chemical additive is between about 25 to about 100 percent of the applied amount of the water insoluble chemical additive when the chemically treated pulp fibers are redispersed in water. The level of chemical retention of the water insoluble chemical additive may range from between about 60 to about 100 percent or between about 80 to about 100 percent retention of the water insoluble chemical additive. The improved level of chemical retention of the water insoluble chemical additive, measured as the change in the level of chemical retention of adding by typical wet-end addition, may range from a lower limit of about 5 percent, about 15 percent, about 25 percent, about 35 percent, about 45 percent, about 55 percent, about 65 percent, and about 75 percent to a higher limit of about 25 percent, about 35 percent, about 45 percent, about 55 percent, about 65 percent, about 75 percent, about 85 percent, about 95 percent, and about 100 percent retention of the water insoluble chemical additive. It is understood that the value for the lower limit is less than the value for the upper limit.

According to another embodiment of the present invention is a method for applying a water insoluble chemical additive to the pulp fiber during the pulp processing stage. During the pulp processing stage, upstream of a paper machine, one can obtain chemically treated pulp fiber. Furthermore, the chemically treated pulp fiber can be transported to several different paper machines that may be located at various sites, and the quality of the finished product from each paper machine will be more consistent. Also, by chemically treating the pulp fiber before the pulp fiber is made available for use on multiple paper machines or multiple runs on a paper machine, the need to install equipment at each paper machine for the water insoluble chemical additive addition can be eliminated.

The method of the present invention for processing pulp fibers also enables higher and more uniform concentrations of the water insoluble chemical additive to be retained by the pulp fibers while at the same time maintaining significantly lower levels of unretained water insoluble chemical additive in the water phase of a papermaking machine compared to paper machine wet end chemical additive additions.

The term "unretained" refers to any portion of the chemical additive that is not retained by the pulp fiber and thus remains suspended in the process water. The term "web-forming apparatus" includes fourdrinier former, twin wire former, cylinder machine, press former, crescent former, and the like of a pulp sheet machine known to those skilled in the art. The term "water" refers to water or a solution containing water and other treatment additives desired in the papermaking process. The term "chemical additive" refers to a single treatment compound or to a mixture of treatment compounds. It is also understood that a chemical additive used in the present invention may be an adsorbable chemical additive.

The consistency of the dried fibrous web is from about 65 to about 100 percent. In other embodiments, the consistency of the dried fibrous web is from about 80 to about 100 percent or from about 85 to about 95 percent. The consistency of the dewatered fibrous web is from about 20 to about 65 percent. In other embodiments, the consistency of the dewatered fibrous web is from about 40 to about 65 percent or from about 50 to about 65 percent. The consistency of the crumb form is from about 20 to about 85 percent. In other embodiments, the consistency of the crumb form is from about 30 to about 60 percent or from about 30 to about 45 percent.

The present method allows for the production of pulp fibers that are useful for making paper products. One aspect of the present invention is a uniform supply of chemically treated pulp fiber, replacing the need for costly and variable chemical treatments at one or more paper machines. Another aspect of the invention resides in a pulp fiber that has a higher water insoluble chemical additive loading than could otherwise be achieved in combination with either no or a relatively low level of unretained water insoluble chemical additive in the process water on a paper machine. This is because water insoluble chemical additive loading via wet end addition is often limited by the level of unadsorbed or unretained water insoluble chemical additive and/or contact time, as well as its associated processing difficulties such as foam, deposits, chemical interactions, felt plugging, excessive dryer adhesion or release or a variety of paper physical property control issues caused by the presence of unadsorbed or unretained water insoluble chemical additive in the process water on the paper machines. Another aspect of the invention is the ability to deliver pulp fiber treated with water insoluble chemical additives that would not otherwise be retained when added in the wet end of a papermaking operation.

According to one embodiment of the present invention, the method comprises adding at least a first chemical additive to pulp fiber. Pulp fibers are mixed with process water thereby forming a fiber slurry. The fiber slurry is transported to a web-forming apparatus of a pulp sheet machine. The fiber slurry is dewatered thereby forming a crumb pulp. A water insoluble chemical additive is applied to the crumb pulp thereby forming a chemically treated crumb pulp containing chemically treated pulp fibers. The chemically treated pulp fibers have an increased or improved level of chemical retention of the water insoluble chemical additive and have the level of chemical retention of the water insoluble chemical additive that is between about 25 to about 100 percent retention of the applied amount of the water insoluble chemical additive when the chemically treated pulp fibers are redispersed in water. The level of chemical retention of the water insoluble chemical additive may range from between about 60 to about 100 percent or between about 80 to about 100 percent retention of the water insoluble chemical additive. The improved level of chemical retention of the water insoluble chemical additive, measured as the change in the level of chemical retention of adding by typical wet-end addition, may range from a lower limit of about 5 percent, about 15 percent, about 25 percent, about 35 percent, about 45 percent, about 55 percent, about 65 percent, and about 75 percent to a higher limit of about 25 percent, about 35 percent, about 45 percent, about 55 percent, about 65 percent, about 75 percent, about 85 percent, about 95 percent, and about 100 percent retention of the water insoluble chemical additive. It is understood that the value for the lower limit is less than the value for the upper limit.

Another aspect of the present invention resides in a method for applying water insoluble chemical additives to pulp fiber. The method comprises creating a fiber slurry comprising process water and pulp fibers. The fiber slurry is transported to a web-forming apparatus of a pulp sheet machine and forming a wet fibrous web. The wet fibrous web is dewatered to a predetermined consistency thereby forming a dewatered fibrous web. A first water insoluble chemical additive is applied to the dewatered fibrous web thereby forming a chemically treated dewatered fibrous web of chemically treated pulp fibers. A second water insoluble chemical additive is applied to the chemically treated dewatered fibrous web thereby forming a dual chemically treated dewatered fibrous web containing dual chemically treated pulp fibers wherein the dual chemically treated pulp fibers have an improved level of chemical retention of the first water insoluble chemical additive and have a level of chemical retention of the first water insoluble chemical additive that is between about 25 to about 100 percent retention of the applied amount of the first water insoluble chemical additive when the dual chemically treated pulp fibers are redispersed in water and wherein the dual chemically treated pulp fibers have an improved level of chemical retention of the second water insoluble chemical additive and have a level of chemical retention of the second water insoluble chemical additive that is between about 25 to about 100 percent retention of the applied amount of the second water insoluble chemical additive when the dual chemically treated pulp fibers are redispersed in water. The level of chemical retention of the first and/or second water insoluble chemical additive may range from between about 60 to about 100 percent or between about 80 to about 100 percent retention of the applied amount of the first and/or second water insoluble chemical additive. The improved level of chemical retention of the first and/or second water insoluble chemical additive, measured as the change in the level of chemical retention of adding by typical wet-end addition, may range from a lower limit of about 5 percent, about 15 percent, about 25 percent, about 35 percent, about 45 percent, about 55 percent, about 65 percent, and about 75 percent to a higher limit of about 25 percent, about 35 percent, about 45 percent, about 55 percent, about 65 percent, about 75 percent, about 85 percent, about 95 percent, and about 100 percent retention of the first and/or second water insoluble chemical additive, respectively. It is understood that the value for the lower limit is less than the value for the upper limit.

Another aspect of the present invention resides in a method for applying water insoluble chemical additives to pulp fiber. The method comprises mixing pulp fibers with process water to form a fiber slurry. The fiber slurry is transported to a web-forming apparatus of a pulp sheet machine and forming a wet fibrous web. The wet fibrous web is dewatered to a predetermined consistency thereby forming a dewatered fibrous web. The dewatered fibrous web is dried to a predetermined consistency thereby forming a dried fibrous web. A first water insoluble chemical additive is applied to the dried fibrous web and applying a second water insoluble chemical additive to the dried fibrous web, thereby forming a dual chemically treated dewatered fibrous web containing dual chemically treated pulp fibers wherein the dual chemically treated pulp fibers have an improved level of chemical retention of the first water insoluble chemical additive and have a level of chemical retention of the first water insoluble chemical additive is between about 25 to about 100 percent retention of the applied amount of the first water insoluble chemical additive when the dual chemically treated pulp fibers are redispersed in water and wherein the dual chemically treated pulp fibers have an improved level of chemical retention of the second water insoluble chemical additive and have a level of chemical retention of the second water insoluble chemical additive is between about 25 to about 100 percent retention of the applied second water insoluble chemical additive when the dual chemically treated pulp fibers are redispersed in water. The level of chemical retention of the first and/or second water insoluble chemical additive may range from between about 60 to about 100 percent or between about 80 to about 100 percent retention of the applied amount of the first and/or second water insoluble chemical additive. The improved level of chemical retention of the first and/or second water insoluble chemical additive, measured as the change in the level of chemical retention of adding by typical wet-end addition, may range from a lower limit of about 5 percent, about 15 percent, about 25 percent, about 35 percent, about 45 percent, about 55 percent, about 65 percent, and about 75 percent to a higher limit of about 25 percent, about 35 percent, about 45 percent, about 55 percent, about 65 percent, about 75 percent, about 85 percent, about 95 percent, and about 100 percent retention of the first and/or second water insoluble chemical additive, respectively. It is understood that the value for the lower limit is less than the value for the upper limit. A finished product having enhanced qualities due to the retention of the chemical additive by the pulp fibers may be produced.

Another aspect of the present invention resides in a method for applying water insoluble chemical additives to pulp fiber. The method comprises mixing pulp fibers with process water to form a fiber slurry. The fiber slurry is transported to a web-forming apparatus of a pulp sheet machine and forming a wet fibrous web. The wet fibrous web is dewatered to a predetermined consistency thereby forming a dewatered fibrous web. Applying a first water insoluble chemical additive to the dewatered fibrous web to the dewatered fibrous web thereby forming a chemically treated dewatered fibrous web. The chemically treated dewatered fibrous web is dried to a predetermined consistency thereby forming a chemically treated dried fibrous web. A second water insoluble chemical additive is applied to the chemically treated dried fibrous web, thereby forming a dual chemically treated dried fibrous web containing dual chemically treated pulp fibers wherein the dual chemically treated pulp fibers have an improved level of chemical retention of the first water insoluble chemical additive and have a level of chemical retention of the first water insoluble chemical additive that is between about 25 to about 100 percent retention of the applied amount of the first water insoluble chemical additive when the dual chemically treated pulp fibers are redispersed in water and wherein the dual chemically treated pulp fibers have an improved level of chemical retention of the second water insoluble chemical additive and have a level of chemical retention of the second water insoluble chemical additive that is between about 25 to about 100 percent retention of the applied amount of the second water insoluble chemical additive when the dual chemically treated pulp fibers are redispersed in water. The level of chemical retention of the first and/or second water insoluble chemical additive may range from between about 60 to about 100 percent or between about 80 to about 100 percent retention of the applied amount of the first and/or second water insoluble chemical additive. The improved level of chemical retention of the first and/or second water insoluble chemical additive, measured as the change in the level of chemical retention of adding by typical wet-end addition, may range from a lower limit of about 5 percent, about 15 percent, about 25 percent, about 35 percent, about 45 percent, about 55 percent, about 65 percent, and about 75 percent to a higher limit of about 25 percent, about 35 percent, about 45 percent, about 55 percent, about 65 percent, about 75 percent, about 85 percent, about 95 percent, and about 100 percent retention of the first and/or second water insoluble chemical additive, respectively. It is understood that the value for the lower limit is less than the value for the upper limit. A finished product having enhanced qualities due to the retention of the chemical additive by the pulp fibers may be produced.

The present invention is particularly useful for adding water insoluble chemical additives such as softening agents to the pulp fibers, allowing for the less problematic and lower cost production of finished products having enhanced qualities provided by the retained water insoluble chemical additives by the pulp fibers.

Hence, another aspect of the present invention resides in paper products formed from pulp fibers that have been chemically treated to minimize the amount of residual, unretained water insoluble chemical additives in the process water on a paper machine. The term "paper" is used herein to broadly include writing, printing, wrapping, sanitary, and industrial papers, newsprint, linerboard, tissue, bath tissue, facial tissue, napkins, wipers, and towels, along with other cellulose structures including absorbent pads, intake webs in absorbent articles such as diapers, bed pads, wet wipes, meat and poultry pads, feminine care pads, and the like made in accordance with any conventional process for the production of such products. With regard to the use of the term "paper" as used herein includes any fibrous web containing cellulosic fibers alone or in combination with other fibers, natural or synthetic. It can be layered or unlayered, creped or uncreped, and can consist of a single ply or multiple plies. In addition, the paper or tissue web can contain reinforcing fibers for integrity and strength.

The term "softening agent" refers to any water insoluble chemical additive that can be incorporated into paper products such as tissue to provide improved runnability, tactile feel, and reduce paper stiffness. These water insoluble chemical additives can also act to reduce paper stiffness or can act solely to improve the surface characteristics of tissue, such as by reducing the coefficient of friction between the tissue surface and the hand.

The term "dye" refers to any chemical that can be incorporated into paper products, such as bathroom tissue, facial tissue, paper towels, and napkins, to impart a color. Depending on the nature of the chemical, dyes may be classified as acid dyes, basic dyes, direct dyes, cellulose reactive dyes, or pigments. All classifications are suitable for use in conjunction with the present invention.

The term "water insoluble" refers to solids or liquids that will not form a solution in water, and the term "water dispersible" refers to solids or liquids of colloidal size or larger that can be dispersed into an aqueous medium.

The term "bonding agent" refers to any chemical that can be incorporated into tissue to increase or enhance the level of interfiber or intrafiber bonding in the sheet. The increased bonding can be either ionic, Hydrogen or covalent in nature. It is understood that a bonding agent refers to both dry and wet strength enhancing chemical additives.

The method for applying water insoluble chemical additives to the pulp fibers may be used in a wide variety of pulp finishing processing, including dry lap pulp, wet lap pulp, crumb pulp, and flash dried pulp operations. By way of illustration, various pulp finishing processes (also referred to as pulp processing) are disclosed in *Pulp and Paper Manufacture: The Pulping of Wood,* $2^{nd}$ Ed., Volume 1, Chapter 12. Ronald G. MacDonald, editor, which is incorporated by reference. Various methods may be used to apply the water insoluble chemical additives in the present invention, including, but not limited to: spraying, coating, foaming, printing, size pressing, or any other method known in the art.

In addition, in situations where more than one water insoluble chemical additive is to be employed, the water insoluble chemical additives may be added to the fibrous web in sequence to reduce interactions between the water insoluble chemical additives.

Many pulp fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulose fibers, cellulose derivatives, and chemically stiffened or crosslinked fibers), some component portion of synthetic fiber (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulp processings), thermomechanically pulped, chemithermomechanically pulped, and the like. Mixtures of any subset of the above mentioned or related fiber classes may be used. The pulp fibers can be prepared in a multiplicity of ways known to be advantageous in the art. Useful methods of preparing fibers include dispersion to impart curl and improved drying properties, such as disclosed in U.S. Pat. Nos. 5,348,620 issued Sep. 20, 1994 and 5,501,768 issued Mar. 26, 1996, both to M. A. Hermans et al. and U.S. Pat. No. 5,656,132 issued Aug. 12, 1997 to Farrington, Jr. et al.

According to the present invention, the chemical treatment of the pulp fibers may occur prior to, during, or after the drying phase of the pulp processing. The generally accepted methods of drying include flash drying, can drying, flack drying, through air drying, Infra-red drying, fluidized bed, or any method of drying known in the art. The present invention may also be applied to wet lap pulp processes without the use of dryers.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION

The invention will now be described in greater detail with reference to the Figures. A variety of conventional pulping apparatuses and operations can be used with respect to the pulping phase, pulp processing, and drying of pulp fiber. It is understood that the pulp fibers could be virgin pulp fiber or recycled pulp fiber. Nevertheless, particular conventional components are illustrated for purposes of providing the context in which the various embodiments of the present invention can be used. Improved retention of chemical additives by the pulp fibers may be obtained by treating the pulp fibers according to the present invention rather than treating the pulp fibers in wet end additions at papermaking machines. In addition, the present invention allows for quick pulp fiber grade changes at the paper mills.

Figure 1:
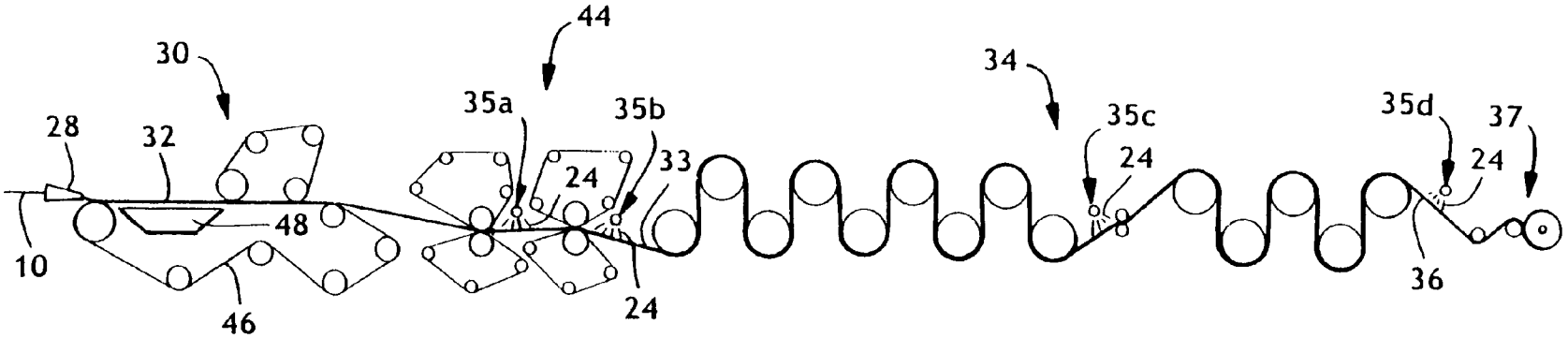
FIG. 1 depicts a schematic process flow diagram of a method according to the present invention for treating pulp fibers with a single water insoluble chemical additive.

FIG. 1 depicts pulp processing preparation equipment used to apply water insoluble chemical additives to pulp fibers according to one embodiment of the present invention. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The wet fibrous web 32 may be subjected to mechanical pressure to remove process water. It is understood that the process water may contain process chemicals used in treating the fiber slurry 10 prior to a web formation step. In the illustrated embodiment, the fourdrinier section 30 precedes a press section 44, although alternative dewatering devices such as a nip thickening device, or the like may be used in a pulp sheet machine. The fiber slurry 10 is deposited onto a foraminous fabric 46 such that the fourdrinier section filtrate 48 is removed from the wet fibrous web 32. The fourdrinier section filtrate 48 comprises a portion of the process water. The press section 44 or other dewatering device known in the art suitably increases the fiber consistency of the wet fibrous web 32 to about 30 percent or greater, and particularly about 40 percent or greater thereby creating a dewatered web 33. The process water removed as fourdrinier section filtrate 48 during the web forming step may be used as dilution water for dilution stages in the pulp processing or discarded.

The dewatered fibrous web 33 may be further dewatered in additional press sections or other dewatering devices known in the art. The suitably dewatered fibrous web 33 may be transferred to a dryer section 34 where evaporative drying is carried out on the dewatered fibrous web 33 to an airdry consistency, thereby forming a dried fibrous web 36. The dried fibrous web 36 is thereafter wound on a reel 37 or slit, cut into sheets, and baled via a baler (not shown) for delivery to paper machines 38 (shown in FIG. 3).

A water insoluble chemical additive 24 may be added or applied to the dewatered fibrous web 33 or the dried fibrous web 36 at a variety of addition points 35*a*, 35*b*, 35*c*, and 35*d* as shown in FIG. 1. It is understood that while only four addition points 35*a*, 35*b*, 35*c*, and 35*d* are shown in FIG. 1, the application of the water insoluble chemical additive 24 may occur at any point between the point of initial dewatering of the wet fibrous web 32 to the point the dried fibrous web 36 is wound on the reel 37 or baled for transport to the paper machines. The addition point 35*a* shows the addition of the water insoluble chemical additive 24 within press section 44. The addition point 35*b* shows the addition of the water insoluble chemical additive 24 between the press section 44 and the dryer section 34. The addition point 35*c* shows the addition of the water insoluble chemical additive in the dryer section 34. The addition point 35*d* shows the addition of the water insoluble chemical additive 24 between the dryer section 34 and the reel 37 or baler (not shown).

The amount of water insoluble chemical additive retained by the chemically treated pulp fibers is about 0.1 kilogram per metric ton or greater. In particularly desirable embodiments, the amount of retained water insoluble chemical additive is about 0.5 kg/metric ton or greater, particularly about 1 kg/metric ton or greater, and more particularly about 2 kg/metric ton or greater. Once the chemically treated pulp fibers are redispersed at the paper machine, the amount of unretained water insoluble chemical additive in the process water phase is between 0 and about 50 percent, particularly between 0 and about 30 percent, and more particularly between 0 and about 10 percent, of the amount of water insoluble chemical additive retained by the chemically treated pulp fibers.

Chemistries suitable for use in the present invention include those not soluble in water. Particularly useful are those water insoluble chemistries that provide a product enhancement benefit when incorporated into a paper or tissue product. Even more useful are those water insoluble chemistries that will not extract with water after having been adsorbed onto cellulosic fiber surfaces. Chemical classifications suitable for use in the invention include, but are not limited to, mineral oil, petrolatum, olefins, alcohols, fatty alcohols, ethoxylated fatty alcohols, esters, high molecular weight carboxylic and polycarboxylic acids and their salts, polydimethylsiloxane and modified polydimethylsiloxane. Modified polydimethylsiloxanes can include amino-functional polydimethylsiloxanes, alkylene oxide-modified polydimethylsiloxane, organomodified polysiloxanes, mixtures of cyclic and non-cyclic modified polydimethylsiloxanes and the like. It should be recognized that water insoluble chemical additives can be applied as dispersions or emulsions and still fall within the scope of the present invention.

A list of water insoluble chemical additives that can be used in conjunction with the present invention include: dry strength agents, wet strength agents, softening agents, debonding agents, adsorbency agents, sizing agents, dyes, optical brighteners, chemical tracers, opacifiers, dryer adhesive chemicals, and the like. Additional water insoluble chemical additives may include: pigments, emollients, humectants, viricides, battericides, buffers, waxes, fluoropolymers, odor control materials and deodorants, zeolites, perfumes, vegetable and mineral oils, polysiloxane compounds, surfactants, moisturizers, UV blockers, antibiotic agents, lotions, fungicides, preservatives, aloe-vera extract, vitamin E, or the like.

At the paper machines 38, (see FIG. 3) the dried fibrous web 36 (of FIG. 1) is mixed with water to form a chemically treated pulp fiber slurry 49. The chemically treated pulp fiber slurry 49 contains the chemically treated pulp fiber having the water insoluble chemical additive 24 (of FIG. 1) retained by the individual fibers. The chemically treated pulp fiber slurry 49 is passed through the paper machine 38 and processed to form a finished product 64. By way of illustration, various paper or tissue making processes are disclosed in U.S. Pat. No. 5,667,636 issued Sep. 16, 1997 to Engel et al.; U.S. Pat. No. 5,607,551 issued Mar. 4, 1997 to Farrington, Jr. et al.; U.S. Pat. No. 5,672,248 issued Sep. 30, 1997 to Wendt et al.; and, U.S. Pat. No. 5,494,554 issued Feb. 27, 1996 to Edwards et al., which are incorporated herein by reference. The finished product 64 has enhanced qualities due to the retention of the water insoluble chemical additive 24 by the chemically treated pulp fibers during the pulp processing. In other embodiments of the present invention, additional water insoluble chemical additive 24 may be added to the chemically treated pulp fiber slurry 49 during stock preparation at the paper machine 38.

Figure 2:
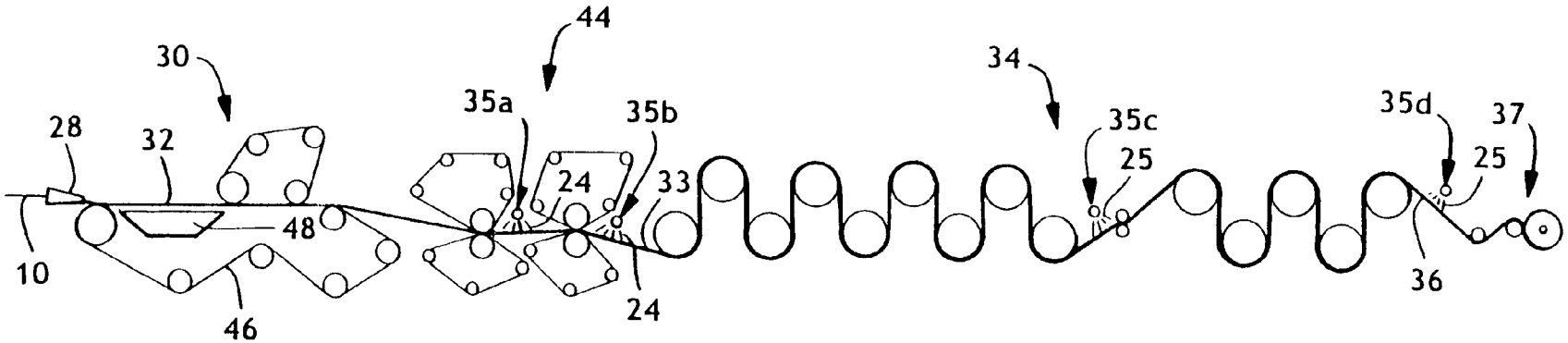
FIG. 2 depicts a schematic process flow diagram of a method according to the present invention for treating pulp fibers with multiple water insoluble chemical additives.

FIG. 2 depicts an alternative embodiment of the present invention in which sequential addition of the first and second water insoluble chemical additives 24 and 25, respectively, are added to the dewatered fibrous web slurry 33 and/or the dried fibrous web 36. It is understood that the addition of the first water insoluble chemical additive 24 may occur any where that the second water insoluble chemical additive 25 may be applied. It is also understood that the addition of the second water insoluble chemical additive 25 may occur any where that the first water insoluble chemical additive 24 may be applied. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The wet fibrous web 32 may be subjected to mechanical pressure to remove process water. In the illustrated embodiment, the fourdrinier section 30 precedes a press section 44, although alternative dewatering devices such as a nip thickening device, or the like known in the art may be used in the pulp sheet machine. The fiber slurry 10 is deposited onto a foraminous fabric 46 such that the fourdrinier section filtrate 48 is removed from the wet fibrous web 32. The fourdrinier section filtrate 48 comprises a portion of the process water. The press section 44 or other dewatering device suitably increases the fiber consistency of the wet fibrous web 32 to about 30 percent or greater, and particularly about 40 percent or greater thereby forming a dewatered fibrous web 33. The process water removed as fourdrinier section filtrate 48 during the web forming step may be used as dilution water for dilution stages in the pulp processing or discarded.

The dewatered fibrous web 33 may be further dewatered in additional press sections 44 or other dewatering devices known in the art. The suitably dewatered fibrous web 33 may be transferred to a dryer section 34 where evaporative drying is carried out on the dewatered fibrous web 33 to an airdry consistency, thereby forming a dried fibrous web 36. The dried fibrous web 36 is thereafter wound on a reel 37 or slit, cut into sheets, and baled via a baler (not shown) for delivery to paper machines 38 (shown in FIG. 3).

The first water insoluble chemical additive 24 may be added or applied to the dewatered fibrous web 33 or the dried fibrous web 36 at a variety of addition points 35*a*, 35*b*, 35*c*, and 35*d* as shown in FIG. 2. It is understood that while only four addition points 35*a*, 35*b*, 35*c*, and 35*d* are shown in FIG. 2, the application of the first water insoluble chemical additive 24 may occur at any point between the point of initial dewatering of the wet fibrous web 32 to the point the dried fibrous web 36 is wound on the reel 37 or baled for transport to the paper machines 38. The addition point 35*a* shows the addition of the first water insoluble chemical additive 24 within press section 44. The addition point 35*b* shows the addition of the first chemical additive 24 between the press section 44 and the dryer section 34. The addition point 35*c* shows the addition of the first chemical additive within the dryer section 34. The addition point 35*d* shows the addition of the first water insoluble chemical additive 24 between the dryer section 34 and the reel 37 or baler.

The second water insoluble chemical additive 25 may be added or applied to the dewatered fibrous web 33 or the dried fibrous web 36 at a variety of addition points 35*a*, 35*b*, 35*c*, and 35*d* as shown in FIG. 2. It is understood that while only four addition points 35*a*, 35*b*, 35*c*, and 35*d* are shown in FIG. 2, the application of the second water insoluble chemical additive 25 may occur at any point between the point of initial dewatering of the wet fibrous web 32 to the point the dried fibrous web 36 is wound on the reel 37 or baled for transport to the paper machines 38 downstream of at least the initial point of application of the first water insoluble chemical additive 24. The addition point 35*a* shows the addition of the second water insoluble chemical additive 25 within press section 44. The addition point 35*b* shows the addition of the second water insoluble chemical additive 25 between the press section 44 and the dryer section 34. The addition point 35*c* shows the addition of the second chemical additive within the dryer section 34. The addition point 35*d* shows the addition of the second water insoluble chemical additive 25 between the dryer section 34 and the reel 37 or baler.

At the paper machines 38, (see FIG. 3) the dried fibrous web 36 (of FIGS. 1 and 2) is mixed with water to form a chemically treated pulp fiber slurry 49. The chemically treated pulp fiber slurry 49 contains the dual chemically treated pulp fiber having the first and second water insoluble chemical additives 24 and 25 retained by the individual fibers. The chemically treated pulp fiber slurry 49 is passed through the paper machine 38 and processed to form a finished product 64. By way of illustration, various paper or tissue making processes are disclosed in U.S. Pat. No. 5,667,636 issued Sep. 16, 1997 to Engel et al.; U.S. Pat. No. 5,607,551 issued Mar. 4, 1997 to Farrington, Jr. et al.; U.S. Pat. No. 5,672,248 issued Sep. 30, 1997 to Wendt et al.; and, U.S. Pat. No. 5,494,554 issued Feb. 27, 1996 to Edwards et al., which are incorporated herein by reference. The finished product 64 has enhanced qualities due to the retention of the first and second water insoluble chemical additives 24 and 25 by the dual chemically treated pulp fibers during the pulp processing. In other embodiments of the present invention, additional second water insoluble chemical additive 25 may be added to the chemically treated pulp fiber slurry 49 during stock preparation at the paper machine 38.

In other embodiments, it is understood that a third, fourth, fifth, so forth, water insoluble chemical additives may be used to treat the dewatered fibrous web 33 and/or dried fibrous web 36.

The amount of first water insoluble chemical additive 24 is suitably about 0.1 kg./metric ton of pulp fiber or greater. In particular embodiments, the first water insoluble chemical additive 24 is a polysiloxane and is added in an amount from about 0.1 kg./metric ton of pulp fiber or greater.

The amount of the second water insoluble chemical additive 25 is suitably about 0.1 kg./metric ton of pulp fiber or greater. In particular embodiments, the second water insoluble chemical additive 25 is a polysiloxane and is added in an amount from about 0.1 kg./metric ton of pulp fiber or greater.

In other embodiments of the present invention, each of the first and second water insoluble chemical additives 24 and 25 may be added to the fiber slurry 10 at a variety of positions in the pulp processing apparatus.

In other embodiments of the present invention, one batch of pulp fibers may be treated with a first water insoluble chemical additive 24 according to the method of the present invention as discussed above while a second batch of pulp fibers may be treated with a second water insoluble chemical additive 25 according to the present invention. During the papermaking process, different pulp fibers or pulp fibers having different treatments may be processed into a layered paper or tissue product as disclosed in the U.S. Pat. No. 5,730,839 issued Mar. 24, 1998 to Wendt et al., which is incorporated herein by reference.

Figure 3:
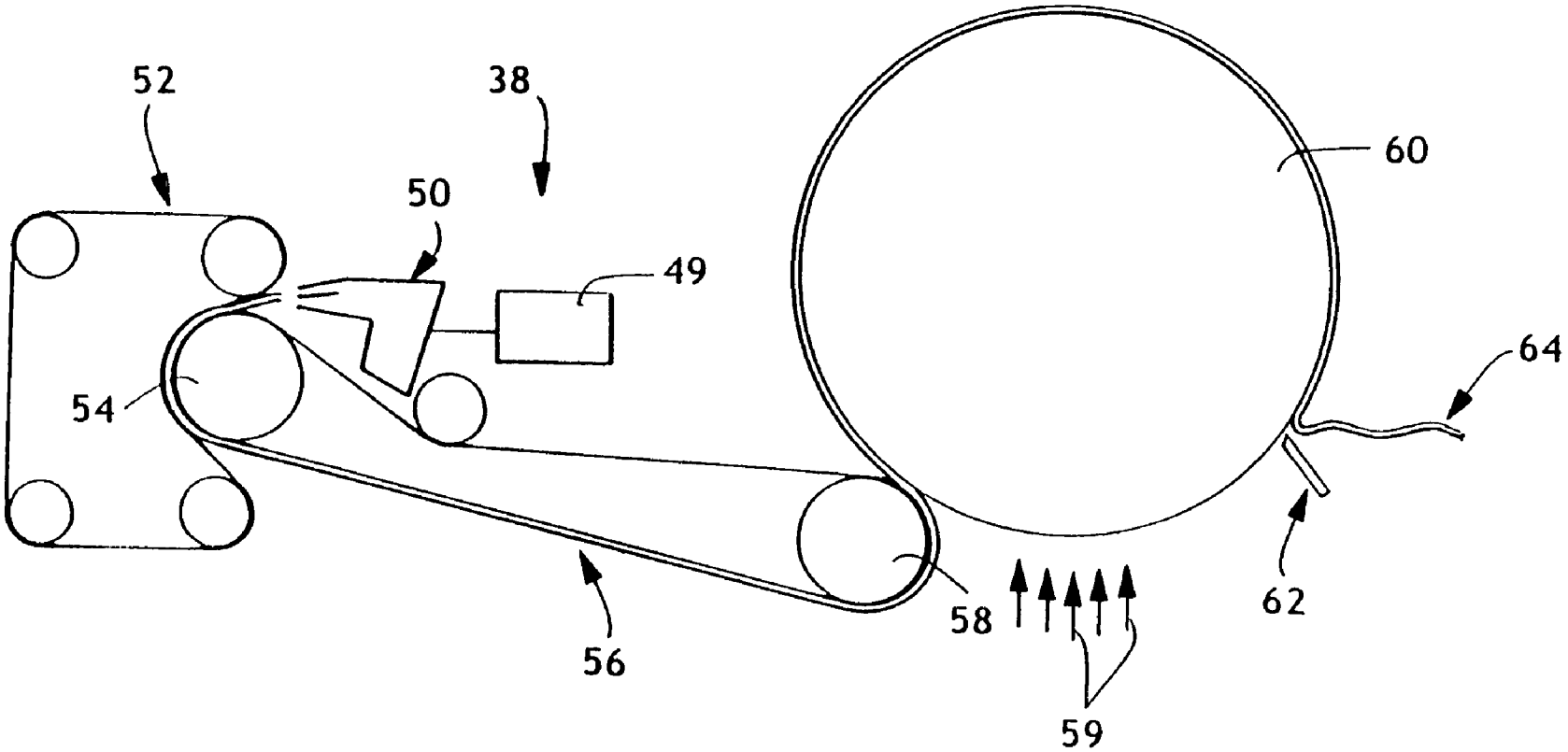
FIG. 3 depicts a schematic process flow diagram of a method of making a creped tissue sheet.

Referring to the FIG. 3, a tissue web 64 is formed using a 2-layer headbox 50 between a forming fabric 52 and a conventional wet press papermaking (or carrier) felt 56 which wraps at least partially about a forming roll 54 and a press roll 58. The tissue web 64 is then transferred from the papermaking felt 56 to the Yankee dryer 60 applying the vacuum press roll 58. An adhesive mixture is typically sprayed using a spray boom 59 onto the surface of the Yankee dryer 60 just before the application of the tissue web to the Yankee dryer 60 by the press roll 58. A natural gas heated hood (not shown) may partially surround the Yankee dryer 60, assisting in drying the tissue web 64. The tissue web 64 is removed from the Yankee dryer by the creping doctor blade 62. Two tissue webs 64 may be plied together and calendered. The resulting 2-ply tissue product can be wound onto a hard roll.

In other embodiments of the present invention, a gradient of the first and/or the second water insoluble chemical additives 24 and 25 along the z-direction of the dewatered fibrous web 33 and/or the dried fibrous web 36 may be established by a directed application of the first and/or the second water insoluble chemical additives 24 and 25. In one embodiment, the first and/or the second water insoluble chemical additives 24 and 25 are applied to one side of the dewatered fibrous web 33 and/or the dried fibrous web 36. In another embodiment, one side of the dewatered fibrous web 33 and/or the dried fibrous web 36 is saturated with the first and/or the second water insoluble chemical additives 24 and 25. In another embodiment, a dual gradient may be established in the z-direction of the dewatered fibrous web 33 and/or the dried fibrous web 36 by applying the first water insoluble chemical additive 24 to one side of the dewatered fibrous web 33 and/or the dried fibrous web 36 and applying the second water insoluble chemical additive 25 to the other (opposing) side of the dewatered fibrous web 33 and/or the dried fibrous web 36. The term "z-direction" refers to the direction through the thickness of the web material.

The first and/or the second water insoluble chemical additives 24 and 25 may be applied so as to establish a gradient wherein about 100 percent of each of the first and/or the second water insoluble chemical additives 24 and 25 is located from the side of the dewatered fibrous web 33 and/or the dried fibrous web 36 treated with the first and/or the second water insoluble chemical additives 24 and 25 to the middle of the dewatered fibrous web 33 and/or the dried fibrous web 36 along the z-direction of the dewatered fibrous web 33 and/or the dried fibrous web 36 and substantially none of each of the first and/or the second water insoluble chemical additives 24 and 25 is located from the middle of the dewatered fibrous web 33 and/or the dried fibrous web 36 to the opposing side of the dewatered fibrous web 33 and/or the dried fibrous web 36 along the z-direction of the dewatered fibrous web 33 and/or the dried fibrous web 36.

The first and/or the second water insoluble chemical additives 24 and 25 may be applied so as to establish a gradient wherein about 66 percent of each of the first and/or the second water insoluble chemical additives 24 and 25 is located from the side of the dewatered fibrous web 33 and/or the dried fibrous web 36 treated with the first and/or the second water insoluble chemical additives 24 and 25 to the middle of the dewatered fibrous web 33 and/or the dried fibrous web 36 along the z-direction of the dewatered fibrous web 33 and/or the dried fibrous web 36 and about 33 percent of each of the first and/or the second water insoluble chemical additives 24 and 25 is located from the middle of the dewatered fibrous web 33 and/or the dried fibrous web 36 to the opposing side of the dewatered fibrous web 33 and/or the dried fibrous web 36 along the z-direction of the dewatered fibrous web 33 and/or the dried fibrous web 36. The gradient may also be established wherein about 100 percent, about 75 percent, about 60 percent, about 50 percent, about 40 percent, about 25 percent, or about 0 percent of each of the first and/or second water insoluble chemical additives 24 and 25 is located from one side of the dewatered fibrous web 33 and/or the dried fibrous web 36 and about 0 percent, about 25 percent, about 40 percent, about 50 percent, about 60 percent, about 75 percent, or about 100 percent of each of the first and/or second water insoluble chemical additives 24 and 25 is located from the opposing side of the dewatered fibrous web 33 and/or the dried fibrous web 36.

It is understood that in any of these embodiments, the first and second water insoluble chemical additives 24 and 25 may be each applied on opposing sides of the dewatered fibrous web 33 and/or the dried fibrous web 36. Alternatively, the first and second water insoluble chemical additives 24 and 25 could be applied to both opposing sides of the dewatered fibrous web 33 and/or the dried fibrous web 36. In still another variation, the first and second water insoluble chemical additives 24 and 25 could be applied to only one side of the dewatered fibrous web 33 and/or the dried fibrous web 36. Where only a first water insoluble chemical additive 24 is applied to the dewatered fibrous web 33 and/or the dried fibrous web 36, the first water insoluble chemical additive 24 may be applied to one side or both opposing sides of the dewatered fibrous web 33 and/or the dried fibrous web 36

In another embodiment of the present invention, the amounts of the first and/or second water insoluble chemical additives 24 and 25 may be reduced from typical amounts while still imparting unique product characteristics due to the distribution of the first and/or second water insoluble chemical additives 24 and 25 on or within the dewatered fibrous web 33 and/or the dried fibrous web 36 as opposed to an embodiment of the present invention wherein an equilibrated distribution of the first and/or second water insoluble chemical additives 24 and 25 of the dewatered fibrous web 33 and/or the dried fibrous web 36. The establishment of a gradient of the application of the first and/or the second water insoluble chemical additives 24 and 25 of the dewatered fibrous web 33 and/or the dried fibrous web 36 is one way in which this may be accomplished.

A directed application of a water insoluble chemical additive to treat only a portion of fibers according to the present invention may result in a product produced having different characteristics than a product having uniformly chemically treated fibers. Additionally, directed applications typically require a lower amount of the water insoluble chemical additive to achieve paper enhancement, thereby minimizing the detrimental effects that result from unretained water insoluble chemical additives in the papermaking water systems.

A wide variety of fluidized bed coating systems can be adapted to coat or treat pulp fibers with a water insoluble chemical additive that enhances the properties of the pulp fibers or the properties of the pulp fibers during the process or methods of making chemically treated finished paper or tissue products. For example, one can use a Wurster Fluid Bed Coater such as the Ascoat Unit Model 101 of Lasko Co. (Leominster, Mass.), the Magnacoater® by Fluid Air, Inc. (Aurora, Ill.), or the modified Wurster coater described in U.S. Pat. No. 5,625,015 issued Apr. 29, 1997 to Brinen et al., herein incorporated by reference. The Wurster fluidized bed coating technology, one of the most popular methods for particle coating, was originally developed for the encapsulation of solid particulate materials such as powders, granules, and crystals, but according to the present invention, can be adapted to deliver a coating of at least one water insoluble chemical additive to the pulp fibers.

The coater is typically configured as a cylindrical or tapered vessel (larger diameter at the top than at the bottom) with air injection at the bottom through air jets or a distributor plate having multiple injection holes. The pulp fibers are fluidized in the gaseous flow. One or more spray nozzles inject the water insoluble chemical additive initially provided as a liquid, slurry, or foam at a point where good contact with the moving pulp fibers can be achieved. The pulp fibers move upwards and descend behind a wall or barrier, from whence the pulp fibers can be guided to again enter the fluidized bed and be coated (treated) again, treated with a second water insoluble chemical additive, or can be removed and further processed. The pulp fibers may also be treated simultaneously with two or more water insoluble chemical additives using one or more nozzles. Ambient dry air or elevated air temperature or the application of other forms of energy (microwaves, infrared radiation, electron beams, ultraviolet radiation, steam, and the like) causes drying or curing of the chemical additive on the pulp fibers. The retention time of the pulp fibers in the fluidized bed a plurality of times to provides the desired amount of treatment of one or more water insoluble chemical additives on the pulp fibers.

The original Wurster fluid bed coaters are described in U.S. Pat. No. 2,799,241 issued Jul. 16, 1957 to D. E. Wurster; U.S. Pat. No. 3,089,824 issued May 14, 1963 to D. E. Wurster; U.S. Pat. No. 3,117,027 issued Jan. 7, 1964 to J. A. Lindlof et al.; U.S. Pat. No. 3,196,827 issued Jul. 27, 1965 to D. E. Wurster and J. A. Lindlof; U.S. Pat. No. 3,207,824 issued Sep. 21, 1965 to D. E. Wurster et al.; U.S. Pat. No. 3,241,520 issued Mar. 21, 1966 to D. E. Wurster and J. A. Lindlof; and, U.S. Pat. No. 3,253,944 issued May 31, 1966 to D. E. Wurster; all of which are herein incorporated by reference. More recent examples of the use of Wurster coaters are given in U.S. Pat. No. 4,623,588 issued Nov. 18, 1986 to Nuwayser et al., herein incorporated by reference. A related device is the coater is disclosed in U.S. Pat. No. 5,254,168 issued Oct. 19, 1993 to Littman et al., herein incorporated by reference.

Other coating methods need not rely on particle fluidization of the pulp fibers in a gas stream. The pulp fibers may be sprayed or treated with one or more water insoluble chemical additives while being mechanically agitated by a shaker or other pulsating device during the papermaking process, such as while the pulp fibers are dropped from one container to another, while the pulp fibers are tumbled in a moving vessel or a vessel with rotating paddles such as a Forberg particle coater (Forberg AS, Larvik, Norway) which can be operated without applied vacuum to keep the water insoluble chemical additives on the surface of the pulp fibers, or while the pulp fibers rest in a bed, after which the pulp fibers may be separated or broken up. In one embodiment, pulp fibers and a water insoluble chemical additive may be first combined and then the pulp fibers are separated into individually coated (treated) pulp fibers by centrifugal forces, as disclosed in U.S. Pat. No. 4,675,140 issued Jun. 23, 1987 to Sparks et al., herein incorporated by reference.

Systems for coating dry particles can also be adapted for pulp fibers according to the present invention. Examples of such equipment include:

- Magnetically Assisted Impaction Coating (MAIC) by Aveka Corp. (Woodbury, Minn.), wherein magnetic particles in a chamber are agitated by varying magnetic fields, causing target particles and coating materials to repeatedly collide. resulting in the coating of the target particles;
- Mechanofusion by Hosokawa Micron Corp. (Hirakata, Osaka, Japan), wherein particles and coating materials in a rotating drum are periodically forced into a gap beneath an arm pad, causing the materials to become heated and joined together to form coated particles, a process that is particularly effective when a thermoplastic material is involved;
- the Theta Composer of Tokuju Corporation (Hiratsuka, Japan), wherein particles and coating material are mechanically brought together by a pair of rotating elliptical heads;
- Henschel mixers from Thyssen Henschel Industritechnik (Kassel, Germany), believed to be useful for combining particles with polymeric materials;
- the Hybridizer of Nara Machinery (Tokyo, Japan), which employs blades rotating at high speed to impact a coating powder onto particles carried by an air stream; and
- the Rotary Fluidized Bed Coater of the New Jersey Institute of Technology, which comprises a porous rotating cylinder with particles inside. Pressurized air enters the walls of the cylinder and flows toward a central, internal exit port. Air flow through the walls of the chamber can fluidize the particles, acting against centrifugal force. As the particles are fluidized, a coating material injected into the chamber can impinge upon the particles and coat them.

With dry particle coating systems, the pulp fibers may first be treated with a first water insoluble chemical additive by any technique, and then subsequently treated with a second water insoluble chemical additive in powder form. The pulp fibers may also be treated with the first and second water insoluble chemical additives simultaneously. Doing so creates a coating treatment in which the second water insoluble chemical additive is selectively distributed near the exterior surface of the coating treatment, and in which the portion of the coating treatment next to the pulp fibers may be substantially free of the second water insoluble chemical additive.

Figure 4:
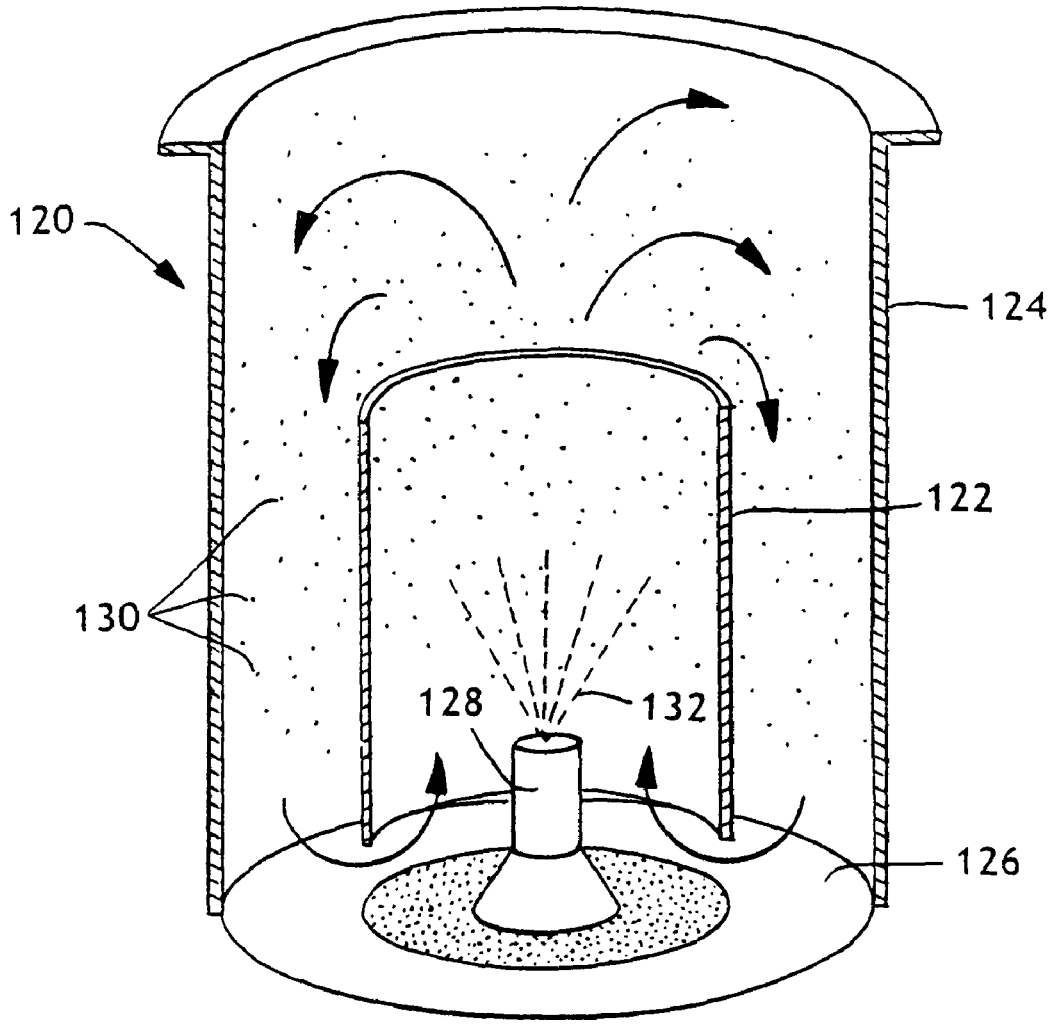
FIG. 4 depicts a fluidized bed apparatus for applying water insoluble chemical additives to pulp fibers.
Figure 5:
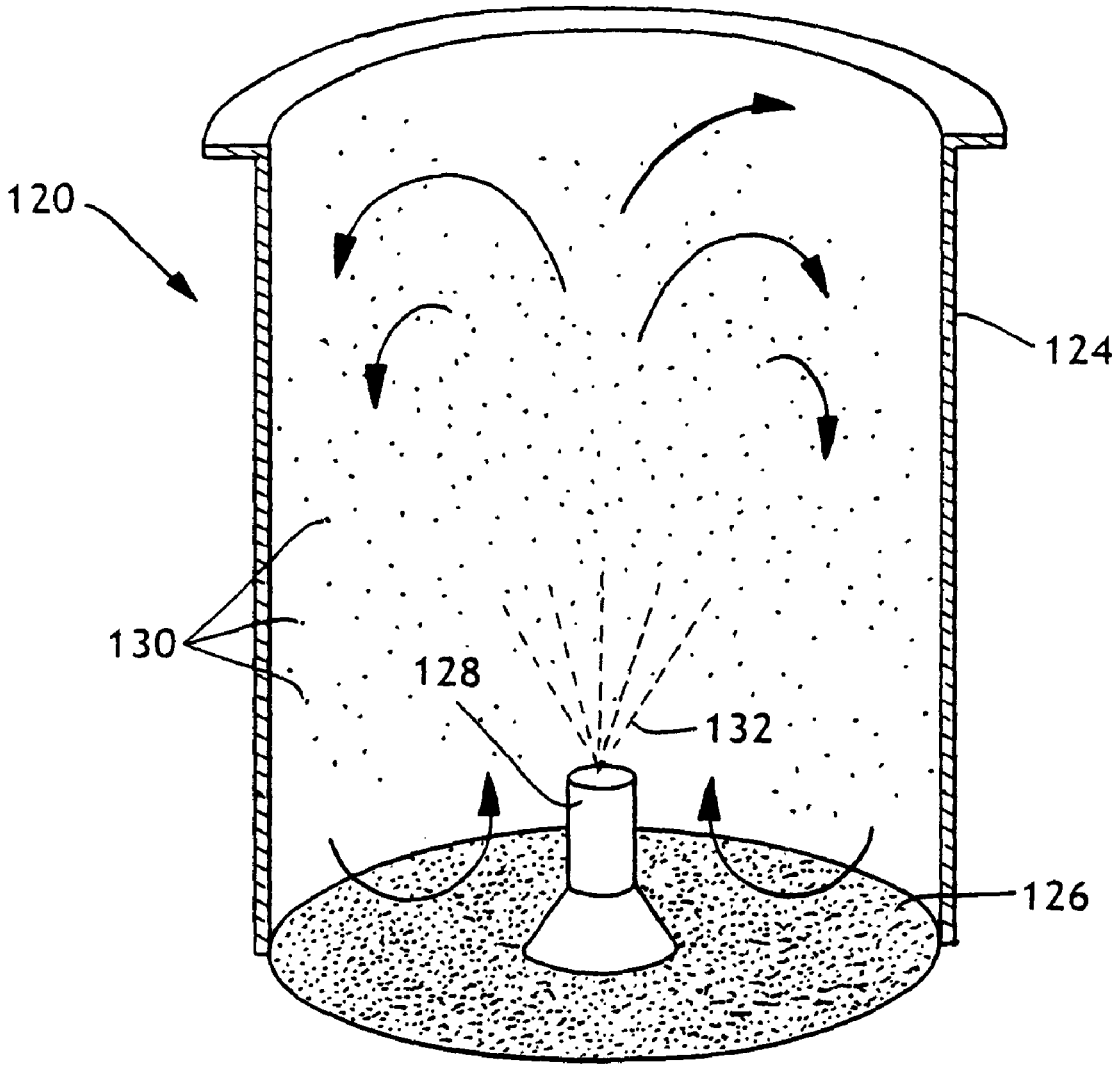
FIG. 5 depicts a fluidized bed apparatus for applying water insoluble chemical additives to pulp fibers.

By way of example, FIGS. 4 and 5 illustrate two versions of a fluidized bed coating process that can be used to coat pulp fibers 130 according to the present invention. In FIG. 4, the depicted apparatus 120 comprises an inner cylindrical partition 122, an outer cylindrical partition 124, and a distributor plate 126 having a central porous or sintered region for injection of gas to entrain pulp fibers 130. The majority of the fluidizing gas flow is directed through the inner cylindrical partition 122. Thus, the general flow pattern of the pulp fibers 130 is upward inside the inner cylindrical partition 122, and downward outside the inner cylindrical partition 122. Unlike several common versions of the Wurster process, in the apparatus 120 of FIG. 4, the spray nozzle 128 is located at the bottom of the apparatus 120, just above the distributor plate 126. The nozzle 128 sprays upward, providing a cocurrent application of a spray 132 of a water insoluble chemical additive to the pulp fibers 130. Any suitable spray nozzle and delivery system known in the art can be used.

FIG. 5 is similar to FIG. 4 except that the inner cylindrical partition 122 of FIG. 4 has been removed, and the porous or sintered region of the distributor plate 126 now substantially extends over the entire distributor plate 126.

Many aspects of the apparatus in FIG. 4 can be modified within the scope of the present invention. For example, the inner cylindrical partition 122 may be replaced with one or more baffles or flow guides (not shown). The walls of either the outer cylindrical partition 124 or inner cylindrical partition 122 may be tapered and may be interrupted with ports or openings for removal of the pulp fibers 130 or addition of a water insoluble chemical additive from one or more spray nozzles (not shown). Either the outer cylindrical partition 124 or the inner cylindrical partition 122 or both may rotate, vibrate, or oscillate. The distributor plate 126 may also move during the treatment operation (e.g., vibrate, rotate, or oscillate). A variety of spray nozzles and delivery systems can be applied to deliver the coating material, including the Silicone Dispensing System of GS Manufacturing (Costa Mesa, Calif.). The water insoluble chemical additives can be applied by spraying from any position in the apparatus 120, or by curtain coating or slot coating or other processes applied to a moving stream of pulp fibers 130.

EXAMPLES

The following examples will describe how to produce chemically treated pulp as described according to the present invention. In these examples the definition of applied refers to the amount of chemical measured to be on the dry fiber mat after treatment. This amount is determined through measurement of chemical described in the Measurement Methods section.

Chemical retention in these examples is defined as the percentage of applied chemical treatment that remains with the fiber after the treated mat is redispersed to a low percent solids content in water. The percent retention was calculated according to Equation 1.

$$\% R = Cw/Cf(100\%) \quad \text{Equation 1}$$

where % R is the chemical retention

Cf is the measured chemical level applied to pulp in units of kg/MT

Cw is the measured chemical level in the dispersed and reformed pulp

Measurement Methods

Siloxane compound contents of samples were measured by gas chromatography after derivitization with boron triflouride diethy etherate. The procedure starts by measuring out 0.1000±0.0010 g of the cellulose sample containing the siloxane compound to the nearest 0.1 mg into 20 mL headspace vials. 100 μL of boron triflouride diethy etherate is added to the vial. After reacting for one hour the headspace of the vial is analyzed for $Me_2SiF_2$ by gas chromatography (GC). The GC system used is a Hewlett-Packard Model 5890 with a Hewlett-Packard 7964 autosampler and a flame ionization, detector. A GSQ column (30 m×0.53 mm i.d.) was used, available from J&W Scientific (catalog #115-3432). The GC system used helium as the carrier gas at a flow rate of 16.0 mL through the column and 14 mL make-up at the detector. The injector temperature was 150° C. and the detector temperature was 220° C. The chromatography conditions were 50° C. for minutes with a ramp of 10° C./minutes to 150° C. This final temperature was held for 5 minutes. The retention time for the dimethyl-difluoro-silicon was 7 minutes.

Calibration samples were prepared by treating control samples with a known amount of siloxane sample. A suitable solvent was used to make up a diluted solution of the siloxane compound. This solvent was then removed prior to derivitization by heating in an oven. The calibration standards were used to prepare a linear fit of siloxane amount versus GC detector analyte peak area. This curve was then used to determine the amount of analyte in the unknown sample, which was then converted into a percent add-on of the siloxane compound by dividing by the weight of the tissue.

Samples containing mineral oil were measured by gravimetric analysis using a Soxhlet extraction procedure. The samples were weighed to 10.00±0.01 g to the nearest 1 mg. The samples were then Soxhlet extracted with chloroform for four hours. The chloroform was removed and evaporated leaving the desired compound, which was then weighed. Calibration samples were used in which untreated pulp samples were spiked with a known amount of the compound of interest. The calibration curve was used to adjust for extracted materials native to the cellulose pulp and the Soxhlet extraction efficiency.

Samples containing polyethylene glycol (PEG) were measured using a high performance liquid chromatography (HPLC) method. The method consists of measuring 5.00±0.01 g of fiber sample and extracting with 100 mL of methanol at room temperature for 3 hours. A 100 μL sample of the methanol was taken and analyzed on a Waters HPLC pump run by a Waters 600E system controller. The column used in these experiments was a Phenomenex Luna C8 HPLC analytical column (150 mm×4.6 mm, 5 μm). The column was equilibrated before use by running a 5 percent acetonitrile/95 percent water solution for 15 minutes. The detector used was a Sedex 55 evaporative light scattering detector. The methanol sample was carried in the column with an acetonitrile/water solution with a concentration gradient of 5 percent to 50 percent acetonitrile per minute. Calibration standards were prepared by spiking control samples with a PEG-400 stock solution and then drying the sample in an oven at 55° C. for 48 hours. Calibration HPLC peak area versus PEG concentration was fitted with a second order polynomial. This equation was then used to calculate the PEG concentration in the unknown samples.

Example 1

The untreated pulp in this example is a fully bleached eucalyptus pulp fiber slurry with a pH value of 4.5. Referencing FIG. 1, this fiber was formed into a mat at a basis weight of 900 grams oven-dry pulp per square meter, pressed and dried to approximately 85 percent solids. Next, neat polydimethylsiloxane, commercially available as DC-200 silicone from Dow Corning Corporation, located in Midland, Mich., was size pressed onto the fiber mat. The size press was operated at 15 pli with the liquid being applied only to bottom roll. The rolls of the nip were comprised of a hard rubber on the bottom and Durarock on the top. The amount of the chemical applied to the mat was approximately 43 kilograms per metric ton of eucalyptus fiber. This amount was determined through the analytical gas chromatography method previously described. The chemical was allowed to remain on the pulp mat for 2 weeks after which it was dispersed to approximately 1.2 percent solids with water at approximately 40° F. for 5 minutes in a British Pulp Disintegrator, available from Lorentzen and Wettre, Atlanta, Ga. The sample was then diluted to 0.3 consistency and formed into a handsheet on a square (9×9 inches) Valley Handsheet Mold, available from Voith Inc., Appleton, Wis. The handsheet was couched of the mold by hand using a blotter and pressed wire-side up at 100 pounds per square inche for 1 minute. Next the handsheet was dried wire-side up for 2 minutes using a Valley Steam Hotplate, available from Voith Inc., Appleton, Wis., with a weighted canvas cover having a lead filled brass tube weighing 4.75 pounds to maintain tension. Samples from the handsheet were taken and used to determine the concentration of siloxane. The concentrations of the siloxane levels were converted into a percent retention basis. The chemical retention level is shown in Table 1.

A control sample was produced by taking untreated pulp and adding approximately the same amount of siloxane as the treated pulp. The pulp, water, and siloxane were mixed in the British Disintegrator for five minutes and used to produce a standard handsheet as described previously. This handsheet treatment was then measured as a control comparison for chemical retention. The data is also found in Table 1.

Example 2

Similar to Example 1 with the exception the chemical applied was a derivatized polysiloxane, DC Q2 8220, available from Dow Corning Corporation, located in Midland, Mich. The polysiloxane was applied at a 100 percent actives content at an add-on level of approximately 63 kg/MT.

Example 3

Similar to Example 1 with the exception the chemical applied was mineral oil, commercially available as Drakeol 7 Lt, commercially available from Penreco, located in Los Angeles, Calif. The mineral oil was applied at a 100 percent actives content at an add-on level of approximately 85 kg/MT.

Example 4

Referencing FIG. 4, fully bleached eucalyptus fiber was introduced into a chamber which tapers upward from a 4-inch diameter at the base to a 6-inch diameter at the top of the main chamber. The unit has a perforated plate at the bottom serving as the distributor plate along with a spray nozzle is mounted at the center of the chamber. 100 grams of oven dried pulp fiber at an approximately 39 percent solid content in the crumb form was fluidized in this chamber through adjustments to airflow in the distributor plate. The inlet airflow was approximately 55 SCFM and 160° F. DC2-8194 siloxane, available from Dow Corning in Midland, Mich. was introduced through the nozzle and atomized into the chamber containing the fluidized fiber. The siloxane was supplied to the nozzle at approximately 70° F. and approximately 0.52 percent as a water emulsion. The air used to atomize the siloxane was at approximately 1.1 SCFM. The fiber was coated by the siloxane and dried by the fluidization air. By adjusting the time the fiber was fluidized and the amount of the siloxane applied, approximately 2.0 kg/MT of siloxane was coated on the fiber. The amount applied was determined by the previously described chromatography method. The chemical was allowed to remain on the pulp mat for 8 weeks after which it was dispersed to approximately 1.2 percent solids with water at approximately 40° F. for 5 minutes in a British Pulp Disintegrator, available from Lorentzen and Wettre, Atlanta, Ga. The sample was then diluted to 0.3 consistency and formed into a handsheet on a square (9×9 inches) Valley Handsheet Mold, available from Voith Inc., Appleton, Wis. The handsheet was couched of the mold by hand using a blotter and pressed wire-side up at 100 pounds per square inch for 1 minute. Next the handsheet was dried wire-side up for 2 minutes using a Valley Steam Hotplate, available from Voith Inc., Appleton, Wis., with a weighted canvas cover having a lead filled brass tube weighing 4.75 pounds to maintain tension. Samples from the handsheet were taken and used to determine the concentration of siloxane. The concentrations of the siloxane levels were converted into a percent retention basis. The chemical retention level is shown in Table 1.

A control sample was produced by taking untreated pulp and adding approximately the same amount of siloxane as the treated pulp. The pulp, water, and siloxane were mixed in the British Disintegrator for five minutes and used to produce a standard handsheet as described previously. The handsheet from this treatment was then measured as a control comparison for chemical retention. The data is also found in Table 1.

Example 5

Similar to Example 4 with the exception that 14 kg/MT of DC2-8194 siloxane was applied using a longer fluidization and coating period allowing the pulp fiber to be treated with more DC2-8194 siloxane.

Example 6

The untreated pulp in this example is a fully bleached eucalyptus pulp fiber slurry with a pH value of 4.5. Referencing FIG. 1, this fiber was formed into a mat at a basis weight of 900 grams oven-dry pulp per square meter, pressed and dried to approximately 85 percent solids. Next, neat polydimethylsiloxane, commercially available as DC-200 silicone from Dow Corning Corporation, located in Midland, Mich. was size pressed onto the fiber mat. The size press was operated at 15 pli with the liquid being applied only to bottom roll. The rolls of the nip were comprised of a hard rubber on the bottom and a Durarock roll on the top. The amount of the chemical applied to the mat was approximately 43 kilograms per metric ton of eucalyptus fiber. This amount was determined through the analytical gas chromatography method previously described. The chemical was allowed to remain on the pulp mat for approximately 3 weeks after which it was combined with untreated eucalyptus pulp at a 1:9 treated to untreated pulp ratio. The combined pulps were, dispersed to approximately 1.5 percent solids with hot water at 120° F. The slurried pulp was then further diluted to approximately 0.20 percent stock which was used to produce a layered soft tissue product. The tissue product was made using the overall process shown in FIG. 3. The first stock layer contained the chemically treated Eucalyptus hardwood pulp fiber, which made up about 65 percent of the tissue web by weight. This first stock layer was the first layer to come into contact with the forming fabric and was also the layer that came into contact with the drying surface of the Yankee dryer. The second stock layer contained northern softwood kraft pulp fiber, which made up about 35 percent of the tissue web by weight. The two layers were pressed together at an approximately 15 percent solids vacuumed, pressed, and dried with a Yankee Dryer.

A modified polyacrylamide dry strength agent, Parez 631 NC commercially available from Cytec Industries Inc. located in West Paterson, N.J., was added to the pulp fiber of the softwood layer. The Parez 631 NC was added to the thick stock at an addition level of about 0.2 percent of the pulp fiber in the entire tissue web. A polyamide epichlorohydrin wet strength agent, Kymene 557LX commercially available from the Hercules, Inc., located in Wilmington, Del., was added to both the Eucalyptus and northern softwood kraft furnishes at an addition level of about 0.2 percent based on the pulp fiber in the entire tissue web. The basis weight of the tissue web was about 7.0 pounds per 2880 square feet of oven dried tissue web.

Referring to the FIG. 3, the tissue web was formed using 2 separate headboxes with a 94M forming fabric commercially available from Albany International, located in Albany, N.Y., and a conventional wet press papermaking (or carrier) felt (Duramesh is commercially available from Albany International, located in Albany, N.Y.) which wraps at least partially about a forming roll and a press roll. The basis weight of the tissue web was about 7.0 pounds per 2880 square feet of oven dried tissue web. The tissue web was then transferred from the papermaking felt to the Yankee dryer by the press roll. The water content of the tissue web on the papermaking felt just prior to transfer of the tissue web to the Yankee dryer was about 80 percent. The moisture content of the tissue web after the application of the press roll was about 55 percent. An adhesive mixture was sprayed using a spray boom onto the surface of the Yankee dryer just before the application of the tissue web by the press roll. The adhesive mixture consisted of about 40 percent polyvinyl alcohol, about 40 percent polyamide resin and about 20 percent quaternized polyamido amine as disclosed in U.S. Pat. No. 5,730,839 issued to Wendt et al. which is herein incorporated by reference. The application rate of the adhesive mixture was about 6 pounds of dry adhesive per metric ton of dry pulp fiber in the tissue web. A natural gas heated hood partially surrounding the Yankee dryer had a supply air temperature of about 680° F. to assist in drying the tissue web. The temperature of the tissue web after the application of the creping doctor was about 225° F. as measured with a handheld infrared temperature gun. The machine speed of the 16 inch wide tissue web was about 50 feet per minute. The crepe blade had a 10 degree bevel and was loaded with a ¾ inch extension. Tissue samples were taken and analyzed for siloxane content using the previous described chromatography method. The concentrations of the siloxane levels were converted into a percent retention basis. The chemical retention level is shown in Table 1.

A control sample was produced by taking untreated pulp, slurrying it and then adding approximately the same amount of siloxane as the treated pulp. The pulp, water, and siloxane slurry were used to create a tissue product as described previously in this example. The tissue from this treatment was then measured as a control comparison for the chemical retention. The data is also found in Table 1.

Example 7

Similar to Example 6 with the exception the chemical applied was a derivatized polysiloxane, DC Q2 8220, available from Dow Corning Corporation, located in Midland, Mich. The polysiloxane was applied at a 100 percent actives content at an add-on level of approximately 63 kg/MT.

Example 8

The untreated pulp in this example is a fully bleached eucalyptus pulp fiber slurry with a pH value of 4.5. Referencing FIG. 1, this fiber was formed into a mat a basis weight of 900 grams oven-dry pulp per square meter, pressed and dried to 50 percent solids. Next, a 6.3 percent (active content basis) water emulsion of a polysiloxane, commercially available as 2-1938 silicone from Dow Corning Corporation, located in Midland, Mich. was sprayed onto the surface of the fiber mat. The emulsion was created by mixing the 2-1938 compound with water at approximately 120° F. for 10 minutes with a Lightnin Duramix mixer with an A100 axial flow impeller commercially available from Lightnin Mixers, located in Rochester, N.Y. The spray was applied using 15 mini-misting hollow cone nozzles with an 80 degree spray angle available from McMaster-Carr. The nozzles were place 2.5 inches center-to-center, 1.5 inches away from the sheet. The nozzles were aligned to spray perpendicular to the sheet applying single coverage. The nozzles' position was approximately 3 feet before the dryer section. Each nozzle's output was adjusted to approximately 55 milliliters per minute of the dispersion by adjusting the dispersion feed pressure to 60 psig. The amount of the chemical applied to the mat was approximately 7.5 kilograms per metric ton of eucalyptus fiber. After application the pulp was dried to approximately 95 percent solids using steam heated cylinder dryers. The compound was allowed to remain on the pulp mat for 2 weeks after which it was dispersed to approximately 1.5 percent solids with hot water at 120° F. The chemically treated pulp was then further diluted to 0.20 percent stock which was used to produce a layered soft tissue product. The tissue product was made using the overall process shown in FIG. 3. The first stock layer contained the chemically treated Eucalyptus hardwood pulp fiber, which made up about 65 percent of the tissue web by weight. This first stock layer was the first layer to come into contact with the forming fabric and was also the layer that came into contact with the drying surface of the Yankee dryer. The second stock layer contained northern softwood kraft pulp fiber, which made up about 35 percent of the tissue web by weight. The two layers were pressed together at an approximately 15 percent solids vacuumed, pressed, and dried with a Yankee Dryer.

A modified polyacrylamide dry strength agent, Parez 631 NC commercially available from Cytec Industries Inc. located in West Paterson, N.J., was added to the pulp fiber of the softwood layer. The Parez 631 NC was added to the thick stock at an addition level of about 0.2 percent of the pulp fiber in the entire tissue web. A polyamide epichlorohydrin wet strength agent, Kymene 557LX commercially available from the Hercules, Inc., located in Wilmington, Del., was added to both the Eucalyptus and northern softwood kraft furnishes at an addition level of about 0.2 percent based on the pulp fiber in the entire tissue web. The basis weight of the tissue web was about 7.0 pounds per 2880 square feet of oven dried tissue web.

Referring to the FIG. 3, the tissue web was formed using 2 separate headboxes with a 94M forming fabric commercially available from Albany International, located in Albany, N.Y., and a conventional wet press papermaking (or carrier) felt (Duramesh is commercially available from Albany International, located in Albany, N.Y.) which wraps at least partially about a forming roll and a press roll. The basis weight of the tissue web was about 7.0 pounds per 2880 square feet of oven dried tissue web.

The tissue web was then transferred from the papermaking felt to the Yankee dryer by the press roll. The water content of the tissue web on the papermaking felt just prior to transfer of the tissue web to the Yankee dryer was about 80 percent. The moisture content of the tissue web after the application of the press roll was about 55 percent. An adhesive mixture was sprayed using a spray boom onto the surface of the Yankee dryer just before the application of the tissue web by the press roll. The adhesive mixture consisted of about 40 percent polyvinyl alcohol, about 40 percent polyamide resin and about 20 percent quaternized polyamido amine as disclosed in U.S. Pat. No. 5,730,839 issued to Wendt et al. which is herein incorporated by reference. The application rate of the adhesive mixture was about 6 pounds of dry adhesive per metric ton of dry pulp fiber in the tissue web. A natural gas heated hood partially surrounding the Yankee dryer had a supply air temperature of about 680° F. to assist in drying the tissue web. The temperature of the tissue web after the application of the creping doctor was about 225° F. as measured with a handheld infrared temperature gun. The machine speed of the 16 inch wide tissue web was about 50 feet per minute. The crepe blade had a 10 degree bevel and was loaded with a ¾ inch extension. Tissue samples were taken and analyzed for siloxane content using the previous described chromatography method. The concentrations of the siloxane levels were converted into a percent retention basis. The chemical retention level is shown in Table 1.

A control sample was produced by taking untreated pulp, slurrying it and then adding approximately the same amount of siloxane as the treated pulp. The pulp, water, and siloxane slurry were used to create a tissue product as described previously in this example. The tissue from this treatment was then measured as a control comparison for the chemical retention. The data is also found in Table 1.

Example 9

This example is used to show the low retention of a water-soluble compound used in this process and therefore why this process is unique to water insoluble compounds. The pulp was prepared identical to Example 8 with the exception that a 6.3 percent (active content basis) water emulsion of a polyethylene glycol was used. The polyethylene glycol used had an average weight of 400 and is commercially available as carbowax 400 from Union Carbide located in Danbury, Conn. A similar control by adding the compound to the dispersed pulp was produced as described in Example 8 with the substitution of polyethylene glycol for siloxane. The data for each may be found in the Table 1.

TABLE 1

Chemical Retention Levels

| Sample | Chemical Compound | Application Method | Chemical Application (kg/MT treated fiber) | Reformed Sample | Chemical Retention (%) | Wet-end Application Comparison Retention (%) |
|---|---|---|---|---|---|---|
| Example 1 | DC 200 | Size press | 43 | Handsheet | 48% | 0% |
| Example 2 | DC Q2 8220 | Size press | 63 | Handsheet | 75% | 7% |
| Example 3 | Mineral Oil | Size press | 85 | Handsheet | 40% | 11% |
| Example 4 | DC 2-8194 | Wurster coater | 2.0 | Handsheet | 85% | 36% |
| Example 5 | DC 2-8194 | Wurster coater | 14 | Handsheet | 84% | 40% |
| Example 6 | DC 200 | Size press | 43 | Tissue | 43% | 24% |
| Example 7 | DC Q2 8220 | Size press | 63 | Tissue | 27% | 2% |
| Example 8 | DC 2-1938 | Spray | 7.5 | Tissue | 73% | 0% |
| Example 9 | PEG 400 | Spray | 10 | Tissue | 7% | 4% |

While the invention has been described in conjunction with specific embodiments, it is to be understood that many alternatives, modifications and variations will be apparent to those skilled in the art in light of the foregoing description. Accordingly, this invention is intended to embrace all such alternatives, modifications and variations, which fall within the spirit and scope of the appended claims.

We claim:

1. A method for preparing chemically treated pulp fiber comprising:

a) creating a fiber slurry comprising process water and pulp fibers;

b) transporting said fiber slurry to a web-forming apparatus of a pulp sheet machine and forming a wet fibrous web;

c) drying said wet fibrous web to a predetermined consistency thereby forming a dried fibrous web;

d) treating said dried fibrous web with an applied amount of a chemical additive thereby forming a chemically treated dried fibrous web containing chemically treated pulp fibers; and (e) dispersing the chemically treated pulp fibers of the chemically treated dried fibrous web in water and draining the water from the chemically treated pulp fibers, wherein said chemically treated pulp fibers retain from between about 10 to about 100 percent of the applied amount of said chemical additive.

2. The method of claim 1 wherein the chemically treated fibers are dispersed in water on a paper machine.

3. The method of claim 1, wherein said dried chemically treated fibrous web includes a z-direction gradient of said chemical additive.

4. The method of claim 1, further comprising dewatering said wet fibrous web thereby forming a dewatered fibrous web.

5. The method of claim 4, further comprising drying said dewatered fibrous web thereby forming a dried fibrous web.

6. The method of claim 5, wherein said chemically treated dewatered fibrous web includes a z-direction gradient of said chemical additive.

7. The method of claim 1 or 2, wherein said chemical additive is selected from the group comprising softening agents, dry strength agents, wet strength agents, opacifying agents, dyes, debonding agents, absorbency agents, sizing agents, optical brighteners, chemical tracers, and mixtures thereof.

8. The method of claim 7, wherein said softener is selected from the group consisting of quaternary ammonium compounds, quaternized protein compounds, phospholipids, silicone quatemaries, quaternized, hydrolyzed wheat protein/dimethicone phosphocopolyol copolymer, organoreactive polysiloxanes, polyhydroxy compounds, and silicone gylcols.

9. The method of claim 1 or 2, wherein said chemical additive is a softener.

10. The method of claim 1 or 2, wherein said chemical additive is an absorbency agent.

11. The method of claim 1 or 2, wherein said chemical additive is a wet strength agent.

12. The method of claim 1 or 2, wherein said chemical additive is a dry strength agent.

13. The method of claim 1, further comprising creating a chemically treated pulp fiber slurry by redispersing said chemically treated dried fibrous web in water.

14. The method of claim 1, wherein said chemical additive is applied to said dried fibrous web in an amount of at least about 0.1 kilograms per metric ton or greater.

15. The method of claim 1, wherein said dried fibrous web has a consistency ranging from about 65 percent to about 100 percent.

16. The method of claim 1, wherein said dried fibrous web has a consistency ranging from about 85 percent to about 95 percent.

17. The method of claim 1, wherein sufficient residence time is provided after said chemical additive is applied to said dried fibrous web to allow for retention of said chemical additive by said pulp fiber of said dried fibrous web.

18. The method of claim 1, further comprising forming a paper or tissue product from said chemically treated dried fibrous web.

19. The method of claim 1 wherein the amount of said chemical additive applied to said dried fibrous web is from about 0.1 to about 5 kilograms per metric ton.

20. The method of claim 1 wherein the amount of said chemical additive applied to said dried fibrous web is from about 1.5 to about 7.4 kilograms per metric ton.

21. A method for applying a chemical additive to pulp fiber, said method comprising:

a) mixing pulp fibers with process water to form a fiber slurry;

b) transporting said fiber slurry to a web-forming apparatus of a pulp sheet machine and forming a wet fibrous web;

c) dewatering said wet fibrous web to a predetermined consistency thereby forming a dewatered fibrous web;

d) applying an amount of a chemical additive to said dewatered fibrous web thereby forming a chemically treated dewatered fibrous web of chemically treated pulp fibers; and (e) dispersing the chemically treated pulp fibers of the chemically treated dewatered fibrous web in water and draining the water from the chemically treated pulp fibers, wherein said chemically treated pulp fibers retain from between about 10 to about 100 percent of the applied amount of said chemical additive.

22. The method of claim 21 wherein the chemically treated pulp fibers are dispersed in water on a paper machine.

23. The method of claim 21, wherein said chemically treated dried fibrous web includes a gradient of said chemical additive.

24. The method of claim 21, further comprising drying said chemically treated dewatered fibrous web to a predetermined consistency thereby forming a chemically treated dried fibrous web.

25. The method of claim 24, wherein said chemically treated dewatered fibrous web includes a gradient of said chemical additive.

26. The method of claim 24, further comprising transporting said chemically treated dried fibrous web to a paper machine and mixing said dried fibrous web with water thereby forming a chemically treated pulp fiber slurry, wherein said chemically treated pulp slurry containing chemically treated pulp fibers having said chemical additive retained thereby.

27. The method of claim 26, further comprising transporting said chemically treated pulp fiber slurry through said paper machine to form a finished paper or tissue product having enhanced quality due to the retention of said chemical additive by said chemically treated pulp fibers.

28. The method of claim 26, wherein the amount of said chemical additive retained by said chemically treated pulp fibers is about 0.1 kilogram per metric ton or greater, and the amount of unretained said chemical additive in said water is between 0 and about 50 percent of the applied amount of said chemical additive retained by said chemically treated dewatered fibrous web when said chemically treated pulp fibers are redispersed in water.

29. The method of claim 21, wherein the amount of said chemical additive applied to said dewatered fibrous web is about 1 kilograms per metric ton or greater.

30. The method of claim 21, wherein the amount of said chemical additive applied to said dewatered fibrous web is about 3 kilograms per metric ton or greater.

31. The method of claim 21, wherein the amount of said chemical additive applied to said dewatered fibrous web is from about 0.1 to about 5 kilograms per metric ton.

32. The method of claim 21, wherein said chemical additive is selected from the group comprising softening agents, dry strength agents, wet strength agents, opacifying agents, dyes, debonding agents, absorbency agents, sizing agents, optical brighteners, chemical tracers, and mixtures thereof.

33. The method of claim 21 wherein the amount of said chemical additive applied to said dried fibrous web is from about 1.5 to about 7.4 kilograms per metric ton.

* * * * *